US011219350B2

(12) United States Patent
Fawaz et al.

(10) Patent No.: US 11,219,350 B2
(45) **Date of Patent: *Jan. 11, 2022**

(54) RETRACTING DISHWASHER RACK SYSTEM

(71) Applicant: Midea Group Co., Ltd., Foshan (CN)

(72) Inventors: Bassam Fawaz, Louisville, KY (US); Robert M. Digman, Goshen, KY (US); Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 438 days.

This patent is subject to a terminal disclaimer.

(21) Appl. No.: 16/214,761

(22) Filed: Dec. 10, 2018

(65) Prior Publication Data

US 2020/0178757 A1 Jun. 11, 2020

(51) Int. Cl.

| | |
|---|---|
| ***A47L 15/50*** | (2006.01) |
| ***A47L 15/42*** | (2006.01) |
| ***A47L 15/00*** | (2006.01) |

(52) U.S. Cl.

CPC ..... *A47L 15/507* (2013.01); *A47L 15/0049* (2013.01); *A47L 15/4259* (2013.01); *A47L 15/506* (2013.01)

(58) Field of Classification Search

None

See application file for complete search history.

(56) References Cited

U.S. PATENT DOCUMENTS

| | | | |
|---|---|---|---|
| 3,402,576 | A | 9/1968 | Krupsky |
| 3,466,105 | A | 9/1969 | Guth |
| 3,560,069 | A | 2/1971 | Doepke |
| 3,670,855 | A | 6/1972 | Lemery |
| 3,726,581 | A | 4/1973 | Doepke |
| 3,799,640 | A | 3/1974 | Jacobs |
| 3,892,453 | A | 7/1975 | Daily |
| 5,657,878 | A | 8/1997 | Austin |
| 5,860,716 | A | 1/1999 | Good et al. |
| 6,048,006 | A | 4/2000 | Antonucci et al. |
| 6,247,771 | B1 | 6/2001 | Miller |
| 7,296,830 | B2 | 11/2007 | Koveal et al. |
| 7,399,041 | B2 | 7/2008 | Prentner et al. |
| 7,410,228 | B2 | 8/2008 | Dickson et al. |
| 7,422,022 | B2 | 9/2008 | Maunsell et al. |
| 7,712,801 | B2 | 5/2010 | Xu et al. |

(Continued)

FOREIGN PATENT DOCUMENTS

| | | | |
|---|---|---|---|
| CN | 101153449 | A | 4/2008 |
| CN | 101176640 | A | 5/2008 |

(Continued)

OTHER PUBLICATIONS

U.S. Patent and Trademark Office, Notice of Allowance issued in U.S. Appl. No. 16/214,785 dated May 14, 2020.

(Continued)

*Primary Examiner* — Rita P Adhlakha

(74) *Attorney, Agent, or Firm* — Middleton Reutlinger

(57) ABSTRACT

A retracting rack for an appliance such as a dish washing appliance. The rack may be positionable between a stowed position and a deployed position. A spring may drive the rack towards the stowed position. A locking mechanism may be used to secure the rack in one or more positions. A release mechanism and/or a reset mechanism may be used to control the retracting cycle of the rack.

15 Claims, 8 Drawing Sheets

(56) References Cited

U.S. PATENT DOCUMENTS

| | | | |
|---|---|---|---|
| 7,731,804 | B2 | 6/2010 | Gunnerson et al. |
| 7,731,805 | B2 | 6/2010 | Banta et al. |
| 7,775,378 | B2 | 8/2010 | Tynes et al. |
| 7,947,943 | B2 | 5/2011 | Jaskol et al. |
| 8,061,790 | B2 | 11/2011 | Anikhindi et al. |
| 8,118,178 | B2 | 2/2012 | Olesiewicz et al. |
| 8,141,968 | B2 | 3/2012 | Velarde et al. |
| 8,166,983 | B2 | 5/2012 | Clerkin |
| 8,387,634 | B2 | 3/2013 | Dalsing |
| 8,511,769 | B2 | 8/2013 | Busalt et al. |
| 8,534,471 | B2 | 9/2013 | Wong et al. |
| 8,757,419 | B2 | 6/2014 | Schessl et al. |
| 8,757,742 | B2 | 6/2014 | McDaniel |
| 8,985,375 | B2 | 3/2015 | Kohles et al. |
| 9,055,851 | B2 | 6/2015 | Johansson |
| 9,241,604 | B2 | 1/2016 | Dries |
| 9,579,009 | B2 | 2/2017 | Bhajak et al. |
| 9,596,975 | B2 | 3/2017 | Bhajak et al. |
| 9,895,046 | B1 | 2/2018 | Wilson et al. |
| 2004/0104649 | A1 | 6/2004 | Muller et al. |
| 2004/0244825 | A1 | 12/2004 | Ashton |
| 2006/0237042 | A1 | 10/2006 | Weaver et al. |
| 2007/0039904 | A1 | 2/2007 | Purushothaman |
| 2008/0018215 | A1 | 1/2008 | Carden et al. |
| 2008/0129168 | A1 | 6/2008 | Banta et al. |
| 2009/0009040 | A1 | 1/2009 | Dellby et al. |
| 2010/0022339 | A1 | 1/2010 | Barve |
| 2010/0244642 | A1 | 9/2010 | Radusin et al. |
| 2011/0011678 | A1 | 1/2011 | Sheffield |
| 2011/0018410 | A1 | 1/2011 | Bastuji et al. |
| 2011/0180118 | A1 | 7/2011 | Schrott |
| 2012/0104914 | A1 | 5/2012 | Jobst et al. |
| 2014/0083472 | A1 | 3/2014 | Baldwin et al. |
| 2014/0137911 | A1 | 5/2014 | Baldwin et al. |
| 2015/0374203 | A1 | 12/2015 | Hirsh et al. |
| 2016/0095498 | A1 | 4/2016 | Cho et al. |
| 2016/0270532 | A1 | 9/2016 | Gleixner et al. |
| 2016/0309982 | A1 | 10/2016 | Gerstner et al. |
| 2017/0027413 | A1 | 2/2017 | Gerstner et al. |
| 2017/0049295 | A1 | 2/2017 | Lagness et al. |
| 2017/0086584 | A1 | 3/2017 | Rehage |
| 2017/0224190 | A1 | 8/2017 | Sakthivel et al. |
| 2017/0273538 | A1 | 9/2017 | Kulkarni et al. |
| 2018/0140165 | A1 | 5/2018 | Roos et al. |
| 2019/0099057 | A1 | 4/2019 | Scalf et al. |

FOREIGN PATENT DOCUMENTS

| | | | |
|---|---|---|---|
| CN | 101558196 | A | 10/2009 |
| CN | 102658534 | A | 9/2012 |
| CN | 203341700 | U | 12/2013 |
| CN | 204378486 | U | 6/2015 |
| CN | 204608424 | U | 9/2015 |
| CN | 106343938 | A | 1/2017 |
| CN | 106691350 | A | 5/2017 |
| CN | 206390870 | U | 8/2017 |
| DE | 102007009540 | A1 | 8/2008 |
| DE | 102013017809 | | 4/2015 |
| EP | 0848930 | A2 | 6/1998 |
| JP | H04218891 | A | 8/1992 |
| JP | H0533292 | U | 4/1993 |
| JP | 2001057955 | A | 3/2001 |
| JP | 2002345712 | A | 12/2002 |
| JP | 2008301921 | | 12/2008 |
| KR | 20030011496 | | 2/2003 |
| KR | 20090007094 | A | 1/2009 |
| WO | WO2013098009 | | 7/2013 |
| WO | WO2017174793 | A1 | 10/2017 |
| WO | WO2017200680 | A1 | 11/2017 |

OTHER PUBLICATIONS

Japan Patent Office, Notice of Reasons for Refusal, issued in Application No. 2020-511478, dated Jun. 29, 2021.
U.S. Patent and Trademark Office, Notice of Allowance issued for U.S. Appl. No. 15/720,573 dated Jan. 9, 2020.
Korean Intellectual Property Office, Office Action issued in Application No. 10-2020-7004117, dated Apr. 12, 2021.
U.S. Patent and Trademark Office, Office Action issued in related U.S. Appl. No. 15/720,573 dated Sep. 12, 2019.
International Search Report and Written Opinion issued in Application No. PCT/CN2019/097406 dated Oct. 31, 2019.
International Search Report and Written Opinion issued in Application No. PCT/CN2019/097434 dated Oct. 29, 2019.
International Search Report and Written Opinion issued in Application No. PCT/CN2019/097379 dated Oct. 30, 2019.
Japanese Patent Office, Non-Final Office Action issued in Application No. 2020-511478, dated Mar. 23, 2021.
U.S. Patent and Trademark Office, Office Action issued in related U.S. Appl. No. 16/214,778 dated Jun. 20, 2019.
Maytag, Maytag Dishwasher Upper Rack Adjuster Wheel Assy Right, www.amazon, Retrieved on Jul. 16, 2018.
Samsung, Dishwasher: Adjusting the Height of the Upper Rack, www.samsung.com, Apr. 9, 2018.
Transmittal of Related Applications.
Miele, AutoClose-Built-in Dishwasher, Apr. 6, 2017.
Electrolux, Pot & Pan Washer with Automatic Hood and Front/Side Feeding, Multi-Rack Support 833mm. Oct. 19, 2016.
Service Manual, Bottom Mount Refrigerators, Feb. 2005.
International Search Report and Written Opinion issued in Application No. PCT/CN2018/074299 dated Jun. 22, 2018.
U.S. Patent and Trademark Office, Notice of Allowance issued in U.S. Appl. No. 16/214,778 dated Jan. 23, 2020.
Korean Intellectual Property Office, Office Action issued in Application No. 10-2020-7004117, dated Oct. 23, 2021.
U.S. Patent and Trademark Office, Office Action issued in U.S. Appl. No. 16/882,044 dated Oct. 12, 2021.

RETRACTING DISHWASHER RACK SYSTEM

BACKGROUND

The present embodiments relate to an appliance rack, drawer, or shelf, with particular embodiments shown for a dishwasher rack for a dishwasher appliance.

Typical dishwasher racks are pulled out and pushed back into place within the dishwasher tub, with the rack riding on rollers, wheels, glides, or rails. Occasionally, these racks are motorized to translate the movement of the dishwasher rack. However, this practice often may be expensive to implement, and the environment (e.g. heat, cold, moisture, etc.) of the dishwasher tub may create a variety of challenges. Thus, there is a need for the dishwasher rack to be capable of retracting into the dishwasher tub with minimal or no motorization.

SUMMARY

In some embodiments of the invention, for example, a dish washing appliance may include a dishwasher tub. In various embodiments, the dish washing appliance may include a dishwasher rack. Moreover, in some embodiments, the dishwasher rack may be positionable between a stowed position in the dishwasher tub and a deployed position, wherein the deployed position is different from the stowed position. In various embodiments, the dishwasher rack may include a rail having geared teeth, a geared wheel rotationally fixed to a shaft, and a torsion spring. In some embodiments, the geared wheel and the shaft rotationally translate together along the geared teeth of the rail between the stowed position and the deployed position. In addition, in various embodiments, the torsion spring may be secured to the shaft. In some embodiments, translating the dishwasher rack from the stowed position towards the deployed position rotates the shaft and correspondingly increases the spring force of the torsion spring urging the dishwasher rack to return towards the stowed position. In various embodiments, the dishwasher rack may include a pawl and a ratchet locking the dishwasher rack in the deployed position. In some embodiments, the ratchet may be secured to the shaft.

In various embodiments, the shaft may be positioned vertically. In some embodiments, the rail may be positioned inwardly from opposing sides of the dishwasher rack adjacent opposing side walls of the dishwasher tub. In various embodiments, the dishwasher rack may include a housing, wherein the torsion spring, the ratchet, the geared wheel, and the pawl may be positioned within the housing. In addition, in some embodiments, the housing may be positioned adjacent a rear side of the dishwasher rack. In some embodiments, the ratchet and the pawl may be positioned between the torsion spring and the geared wheel within the housing. In various embodiments, the rail may project from a rear wall of the dishwasher tub to the dishwasher rack. In some embodiments, the torsion spring may be a spiral spring. Moreover, in various embodiments, the rail may be positioned between a spray arm assembly and a basket of the dishwasher rack in a direction of travel from the stowed position to the deployed position.

In some embodiments, a dishwasher rack for a dish washing appliance may include a basket capable of occupying a stowed position within the dish washing appliance. In various embodiments, the dishwasher rack may include a shaft having a geared wheel fixed relative to the shaft, the geared wheel rotationally engaging a rail with corresponding geared teeth. In addition, in some embodiments, the dishwasher rack may include a torsion spring and a ratchet secured to the shaft. In various embodiments, when the basket and the shaft translate from the stowed position thereby rotating the shaft relative to the rail, tension in the torsion spring increases and urges the dishwasher rack towards the stowed position. In some embodiments, the dishwasher rack may include a pawl operably engaging the ratchet to lock the rotation of the geared wheel relative to the rail.

In various embodiments, the dishwasher rack may include a housing including the geared wheel, the shaft, the ratchet, the torsion spring, and the pawl. In some embodiments, the housing may be adjacent a rear wall of the basket. In various embodiments, the shaft may be vertically positioned. Moreover, in some embodiments, the rail may be spaced inwardly from each side wall of the basket. In various embodiments, the one or more torsion springs may be a spiral spring.

In addition, in various embodiments, a method of retaining a dishwasher rack in an extending position away from a stowed position within a dish washing appliance may comprise the step of providing a dishwasher rack having a torsion spring, a ratchet, a geared wheel, and a geared rail rotationally and translationally engaged by the geared wheel, and a pawl operably engaging the ratchet in a locked position and an unlocked position. In some embodiments, the method may include positioning the dishwasher rack from a stowed position to one or more deployed positions. In various embodiments, the method may include increasing the tension force of the torsion spring when positioning the dishwasher rack from the stowed position towards the one or more deployed positions. Moreover, in some embodiments, the method may include locking the dishwasher rack in the one or more deployed positions when the pawl engages the ratchet in the locked position. In some embodiments, the method may include automatically retracting the dishwasher rack from the one or more deployed positions towards the stowed position when the pawl disengages the ratchet in the unlocked position.

In various embodiments, the method may include the geared rail projecting from a rear wall of a dishwasher tub. In some embodiments, the method may include rotating the geared wheel about a substantially vertical axis. In addition, in some embodiments, the step of automatically retracting the dishwasher rack may include the torsion spring rotating the geared wheel along the geared rail. In various embodiments, the method may include the dishwasher rack including a pawl and a ratchet to lock the dishwasher rack.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
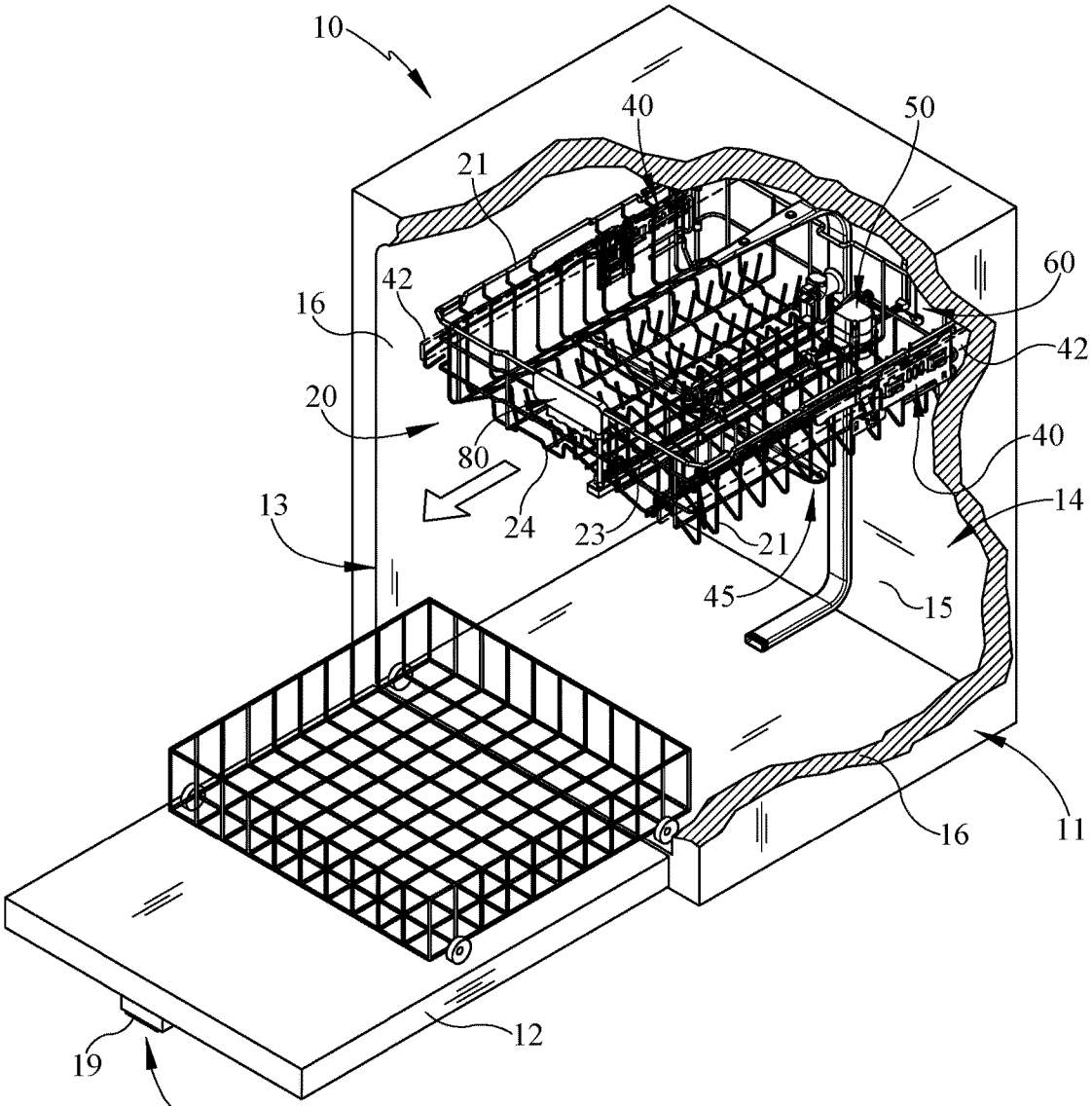
FIG. 1 is a perspective view of one embodiment of an upper retractable dishwasher rack illustrating a lower stowed position, with portions of the housing and dishwasher tub removed.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other appliances, such as, for example, ovens, refrigerators, and the like. For example, one or more drawers for a bottom mount freezer of a refrigerator appliance may include the apparatus and techniques to auto-retract. Further, kitchen and/or bathroom shelves and cabinets may utilize the herein-described apparatus and techniques.

Embodiments for a dish washing machine are shown herein for ease of understanding. For example, a front-load dish washing machine that includes a front-mounted door 12 in a cabinet or housing 11 that provides access to a horizontally-oriented dishwasher rack 20 housed within the cabinet or housing 11 may be used. More specifically, the dishwasher rack 20 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer of a dish washing appliance.

Turning now to the drawings, wherein like numbers denote like parts throughout the several views, FIG. 1 illustrates an example dish washing appliance 10 in which the various technologies and techniques described herein may be implemented. Dish washing appliance 10 is a front-load dish washing machine, and as such may include a front-mounted door 12 defining an opening 13 that provides access to a horizontally-oriented dishwasher tub 14. The door 12 may be coupled with a cabinet or housing 11 that may house the dishwasher tub 14 in some embodiments. Door 12 is generally hinged along a front or front edge of the housing 11 adjacent the opening 13 and is pivotable between the opened position illustrated in FIGS. 1 and 2 and a closed position (not shown). When door 12 is in the open position, dishes, utensils, pans, and other washable items may be inserted into and removed from the one or more dishwasher racks 20 through the opening 13 in the front of cabinet or housing 11. Control over dish washing appliance 10 by a user is generally managed through a control panel 18 disposed on a door 12 (not shown) and implementing a user interface 19, and it will be appreciated that in different dish washing machine designs, control panel 18 may include various types of input and/or output devices, including various knobs, buttons, lights, switches, textual and/or graphical displays, touch screens, etc. through which a user may configure one or more settings and start and stop the dishwasher rack cycle or movement as described herein. For example, the control panel, or portions thereof, may be included with the dishwasher rack, on the interior or exterior of the door, and/or adjacent the rack within the opening of the dish washing machine. For example in some embodiments, portions of the controls may be accessible when the door is in the open position. In other embodiments, the one or more racks may close/open, lock, and/or unlock from a position by proximity of one or more users and/or by a one or more gestures/forces or bodily movement relative to the rack and/or portions of the dish washing machine.

As shown in the figures, the one or more dishwasher racks 20, or portions thereof, may be positionable relative to the dish washing appliance 10 between a stowed or un-deployed position (FIGS. 1 and 3) and a deployed or different position (FIGS. 2, 4, 5, and 6). At least one of the stowed positions of the dishwasher rack 20 may be used when one or more of the washing cycles is in operation. In use, the deployed position may be one or more horizontal positions different from one or more of the stowed positions. For example in one embodiment, one deployed position or partially opened position may be a position other than when the rack is in its fully extended position out of the dishwasher tub 14. One or more deployed positions may be a horizontal position to dry, load, and/or unload dishes, utensils, or the like. The one or more dishwasher racks 20 may travel in a substantially horizontal plane. The horizontal plane may be into and/or out of the dishwasher tub 14 or cavity. Although the substantially linear movement of the dishwasher rack cycle may occur along the horizontal plane in a variety of heights as shown, the linear travel may be in a variety of angles in one or both the directions into or out of a position.

As illustrated in the figures, the dishwasher rack 20 may be retractable to return towards the stowed position with reduced or no assistance by the user. The user has the ability to manually increase the spring/restore force of one or more torsion springs 30 (e.g. FIG. 5) when positioning the dishwasher rack 20 towards one or more deployed positions or away from the dishwasher tub 14. The torsion spring force or restore force of the torsion spring 30 drives/urges the dishwasher rack 20, or portions thereof, towards the stowed position. In the stowed position, the torsion spring 30 may be at rest or an untensioned state, or a less tensioned state than when in one or more deployed positions. When the user progressively forces the dishwasher rack 20 in a direction away from the dishwasher tub 14, the torsion spring 30 increases in tension to a one or more tensioned states, such that energy is stored within the torsion spring 30. The energy stored while pulling out the dishwasher rack 20 may automatically return/retract the dishwasher rack 20 back towards the stowed position and/or dishwasher tub 14 when released by the user. As shown in the embodiment, the dishwasher rack 20 may be releasably secured/locked temporarily in one or more deployed positions until released (e.g. release mechanism, controls, switch, button, handle, force, etc.) towards the dishwasher tub 14 or one or more positions (e.g. the stowed position and/or deployed position more proximal to the dishwasher tub). Although the dishwasher rack spring or tension device may be a torsion spring 30, the spring may be a variety of constructions, shapes, sizes, quantities, and positions with the dishwasher rack. In some embodiments, the torsion spring may be a clock spring and/or coil spring. In a preferred embodiment, the torsion spring may be a spiral or clock spring as shown.

Figure 2:
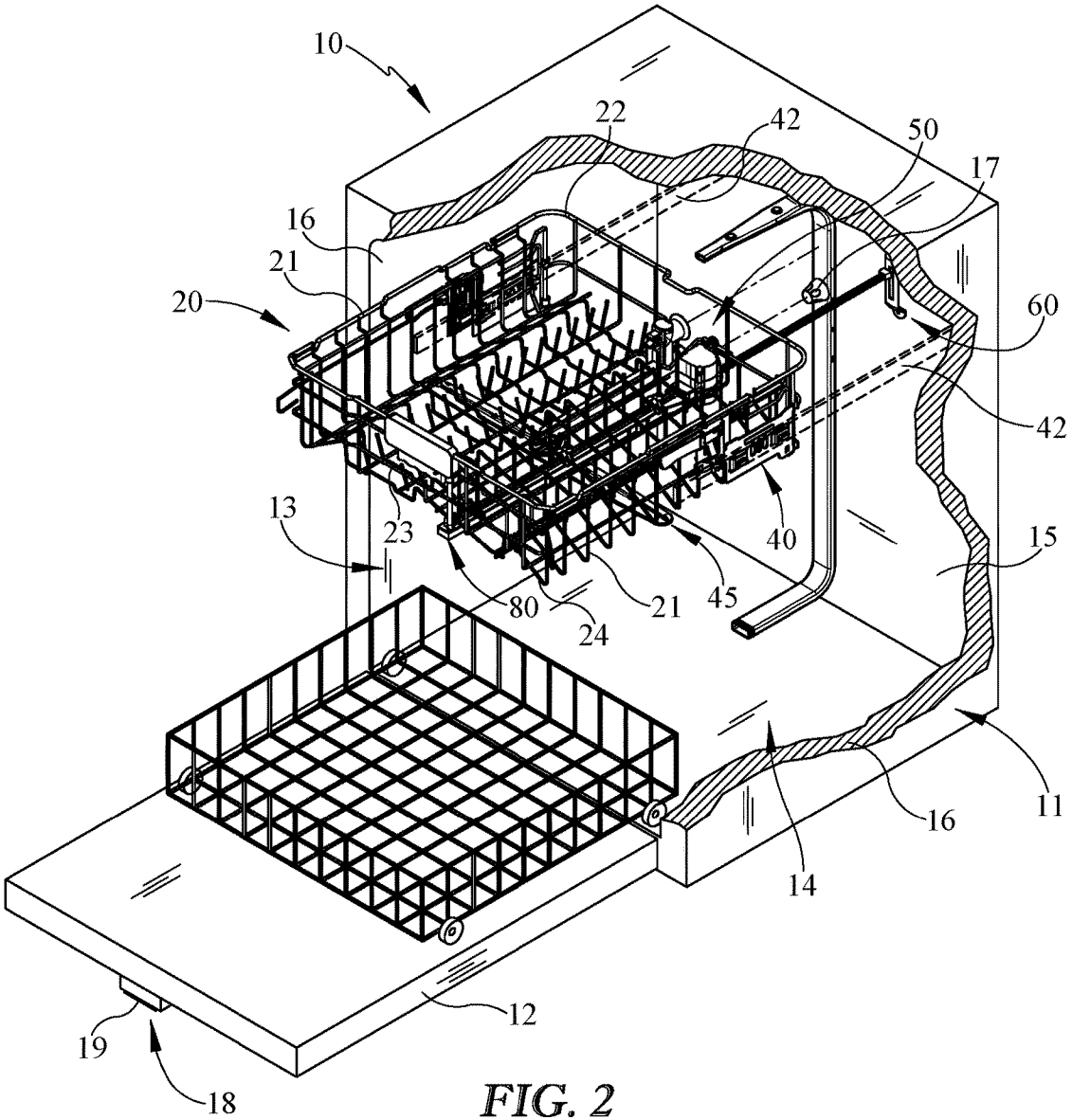
FIG. 2 is a perspective view of the embodiment of the upper dishwasher rack of FIG. 1 illustrating an upper deployed position and locking mechanism releasably securing the position of the rack, with portions of the housing and dishwasher tub removed.

The dishwasher rack 20 may be the upper and/or lower dishwasher rack in some embodiments. In a preferred embodiment as shown, the dishwasher rack 20 is the upper dishwasher rack. The upper dishwasher rack may be pulled outward by the user, and upon release the dishwasher rack 20 may automatically retract back into the cavity, under the stored power of the torsion spring 30. In some embodiments, one or more portions of a dishwasher rack may be auto-retracted towards a stowed position within a dishwasher rack 20 and/or tub 14. In some implementations, the dishwasher rack may be adjustable to a plurality of heights and still allow retraction from the deployed position to the stowed position. The dishwasher rack 20 may include a variety of rack height adjustment brackets or mechanisms 40 allowing the rack to adjust between at least two heights (e.g. upper height, lower height, etc.) within the dishwasher tub. In various embodiments, the brackets 40 are positioned adjacent the side walls 21 of the basket or rack 20 adjacent the typical extensions, slides, wheels, rollers, or glides 42 adjacent the dishwasher tub 14 to allow the translation with respect thereto and still allow the auto-retract apparatus and techniques to be used. As shown in FIG. 1, the upper rack 20 is positioned in the lower or first position relative to the tub 14 and correspondingly the height adjustment device 60 is in a lower position (e.g. the sliding engagement 62 or sliding member 65 is in the lower position). Conversely as shown in FIG. 2, the upper rack 20 is positioned in the upper or second position relative to the tub 14 and correspondingly the height adjustment device 60 is in an upper position (e.g. the sliding engagement 62 or sliding member 65 is in the upper position). The dishwasher rack 20 and/or retracting mechanism 50 may retract in at least two or more vertical positions or heights. Further, the dishwasher rack 20 may also include one or more adjustable spray arms or assemblies 45 in some embodiments repositioned with the rack's height adjustment. The spray arms 45 may be in fluid communication with one or more docking stations 17 when the rack is in the stowed position in one or more of the adjustable heights of the rack 20.

As illustrated in the figures, the torsion spring 30 stores energy/power to automatically retract the dishwasher rack 20 back towards the stowed position inside the dishwasher tub 14. In the one embodiment shown, the retracting mechanism 50 includes at least a pinion gear 52 rotationally and translationally engaging a rack gear 54 tensioned by the torsion spring 30 to translate the rack 20. The pinion gear 52 of the dishwasher rack 20 may include at least one axle or geared elongated shaft 51 with one or more geared or toothed engagements 52*s*. The pinon gear 52 operably engages the rack gear 54, such as an elongated rail with teeth 54*a*. Although the rack gear 54 is shown centrally located/extending from the rack or rear wall 22 or spaced inwardly and away from the side walls 21 of the rack and/or dishwasher tub 14, it should be understood that the rack gear 54 and/or retracting mechanism 50 may be positioned adjacent to or on the interior of the dishwasher tub 14. The geared engagement between the shaft 51 and rail 54 reduces slipping and allows continuous rotation and translation of the shaft 51/rack 20 relative to the rail 54. The torsion spring 30 may be secured to both the rotationally translating pinion gear 52 (e.g. geared shaft 51) and to a remaining portion of the translating dishwasher rack 20 or housing 53. For example, the torsion spring 30 may be fixed at one end to the shaft 51 and the other end to the basket or rack 20 and/or gearbox/housing 53. As the shaft 51 and pinion gear/geared wheel 52 rotate together translationally along the elongated rail 54 of geared teeth 54*a* (e.g. when dishwasher rack is positioned towards the deployed position), the torsion spring 30 winds up thereby increasing the tension force or stored energy. It should be understood, the counter rotation of the shaft or axle 51 and/or pinion gear 52 may correspondingly reduce the tension force in some embodiments.

Figure 3:
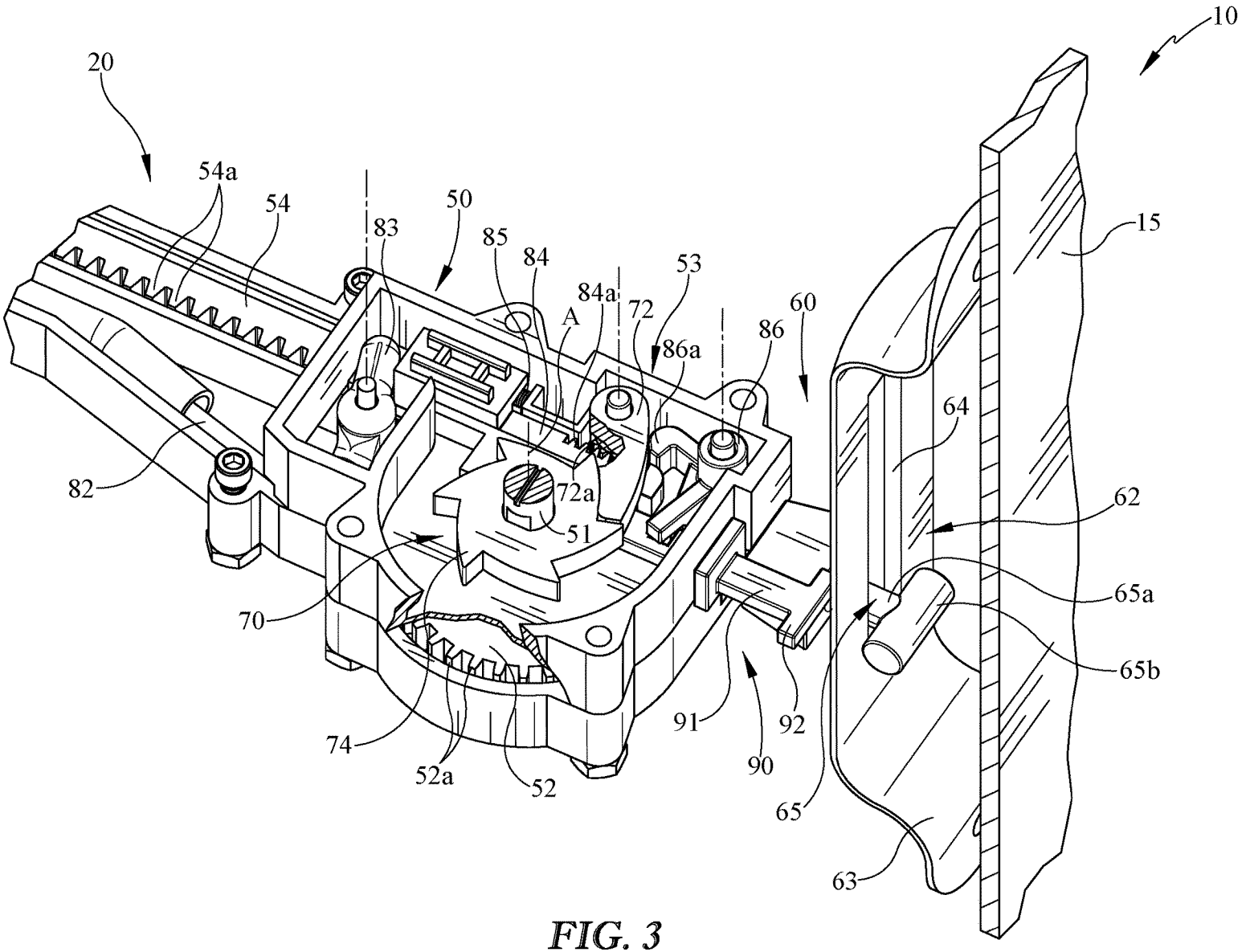
FIG. 3 is an enlarged perspective view of a portion of the dishwasher rack of FIG. 1 in a lower stowed position within the dishwasher tub illustrating an embodiment of the reset mechanism in the retracted position reengaging the locking mechanism to the locked configuration.
Figure 4:
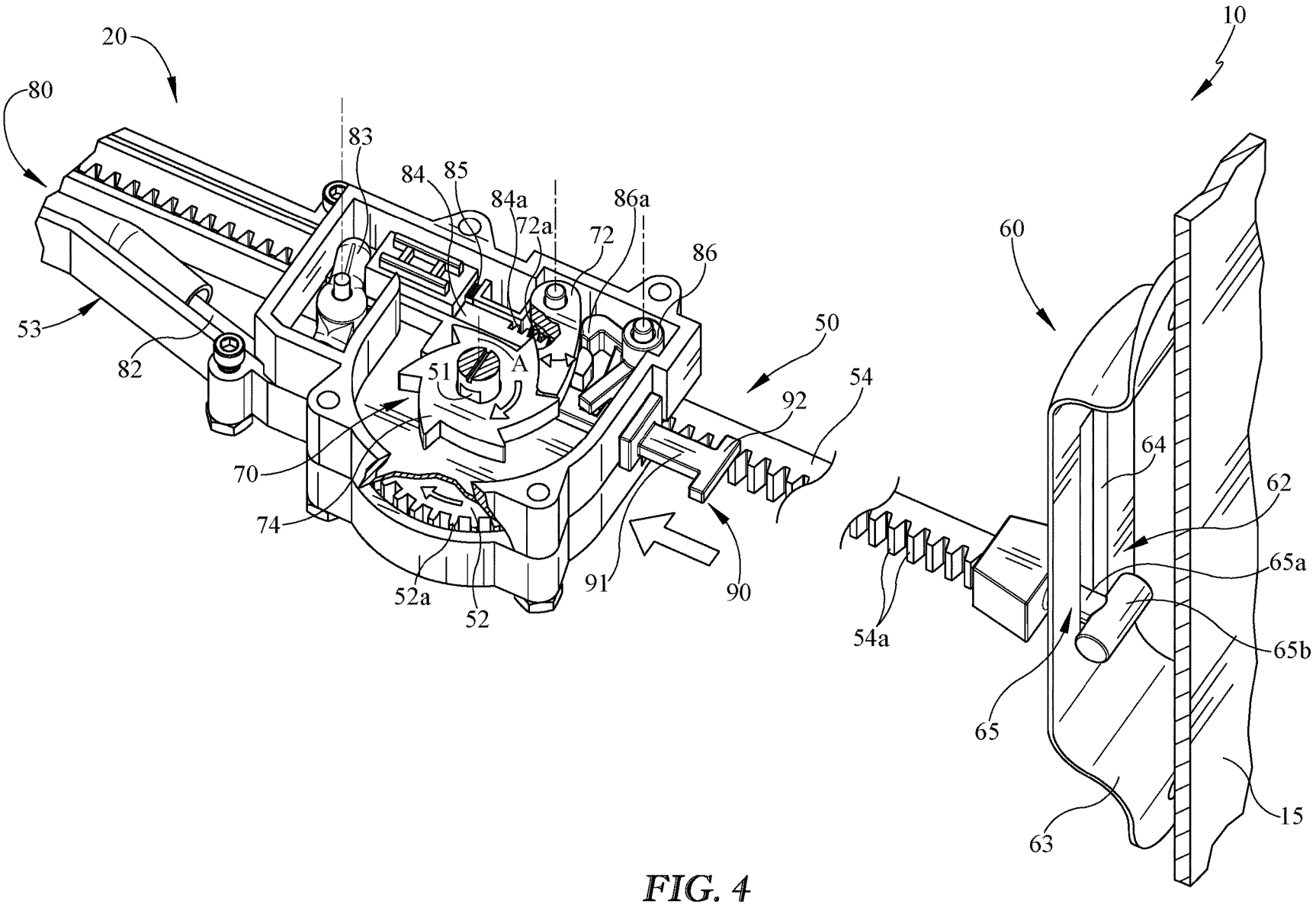
FIG. 4 is an enlarged perspective view of a portion of the dishwasher rack of FIG. 3 with the retracting mechanism and the rack in a lower deployed position and illustrating the locking mechanism in the locked configuration.

In some implementations, the rack gear 54 and the pinion gear 52 may be orientated and/or positioned in a variety of ways and methods to the dishwasher rack 20. As shown in FIGS. 3 and 4, the shaft 51 and pinion gear 52 rotate about a vertical axis A and engage the teeth 54*a* of the rack gear 54 orientated laterally towards the side walls 21, 16 of the rack/tub 20, 14. The torsion spring 30 may also be tensioned about the vertically orientated shaft 51. The rack gear 54 and pinion 52 may be positioned inwardly or centrally to the side walls of the dishwasher rack and/or tub. The rack gear 54 and pinion gear 52 may be positioned above the spray arm assembly 45 (e.g. rotating spray arms) as in the one embodiment shown. The geared rail or rack gear 54 may project from the rear wall 15 of the tub 14. The rack gear 54 may be extended in a direction from the rear wall 22 of the rack 20 to the front wall 23 of the rack 20 and be positioned adjacent the bottom wall 24 of the rack 20 above the extent of the spray arm assembly 45. As such, dishware or items may be positioned within the rack above one or more portions of the retracting mechanism (e.g. housing, rack gear, pinion gear, etc.).

The embodiment of the dishwasher rack 20 shown in Figures includes the shaft 51 and at least one geared wheel 52. The geared engagement (e.g. between rail 54 and geared wheel 52) that winds-up the torsion spring 30 may be in the central portion of the dishwasher rack 20 between opposing one or more slides 42 connecting the dishwasher rack 20 to the dishwasher tub 14.

The rack gear 54 and the pinion gear 52 of the retracting mechanism 50 may be positioned with the rack 20 at a variety of heights relative to the dishwasher tub and still retract and/or extend between the deployed and stowed positions. A portion of the retracting mechanism 50 may maintain translationally fixed (e.g. in the direction of rack deployment or retraction, horizontal direction) or engaged to a stationary or remaining portion of the dishwasher tub or appliance.

A height adjustment device 60 allows the retracting mechanism 50 and/or rack gear 54 (e.g. rails with gear teeth) to be in a translationally fixed positon within the tub 14 when the retracting rack cycles between stowed and deployed positions. This allows the rack gear 54 to travel vertically with the rack 20 between a plurality of heights within the dishwasher via bracket 40 (e.g. different heights in FIGS. 2 and 3). The height adjustment device 60 may engage a portion of the retracting mechanism 50 to the rear wall 15 of the dishwasher tub 14 or another fixed appliance structure. The height adjustment device 60 maintains the retracting mechanism 50 of the dishwasher rack 20 engaged to the dishwasher tub 14 between different vertical positions. In one implementation, the rack gear 54 is fixed to the dishwasher tub 14 (e.g. rear wall 15) independent of the height of the rack 20 within the dishwasher tub 14. The height adjustment device 60 may include a sliding engagement 62 between the retracting mechanism 50 and the dishwasher tub 14 and/or appliance 10 to allow the retracting mechanism to slide vertically in a vertical direction between vertical positons and still remain fixed in one or more directions perpendicular to the vertical direction. The sliding engagement 62 may include a pin and slot engagement. As shown in the one embodiment, the pin and slot engagement, if used, may include a bracket 63 secured to the rear wall 15 of the dishwasher tub 14 having a slot 64 (e.g. vertical). It should be understood that the rear wall 15 may include a slot without having a separate bracket in some embodiments. A vertical sliding member 65 may slide in a vertical direction and still be attached to the rear wall 15. As shown in the one embodiment in the figures, the sliding member 65 may extend from the rack gear 54 and comprise a pin 65*a* slideably engaging the slot 64 between the two or more heights of the rack 20 and/or retracting mechanism 50. The pin 65*a* may have a bar or retention structure 65*b* restricting removal (e.g. horizontal, transverse to slot movement) from the slot 64. The translational movement of the pin 65*a* away from the bracket 63 and/or rear wall 15 of the tub 14 may be limited to fix the translational movement of the rack gear 54. Although the height adjustment device 60 may be centrally located in the rack 20 and/or tub 14 (e.g. spaced away from each one of the opposing side walls 16 of the tub), it should be understood that the retracting mechanism 50 and/or height adjustment device 60 may be spaced or positioned in a variety of positions relative to the rack 20 (e.g. side wall 21, 16).

It should be understood that the height adjustment device 60 for the retracting mechanism 50 and/or rack 20 may be a variety of constructions, quantities, positions, shapes, and sizes and still be within the scope of the invention. For example, the pin 65*a* may be projecting from the rear wall 15 of the dishwasher tub 14 and the slot structure 64 may be coupled to the retracting mechanism and/or rack. Moreover, in some implementations, the retracting mechanism 50 (e.g. rack gear) may be coupled to the rear wall 15 of the dishwasher tub 14 by a flexible member or cable. In some implementations, a wheel and rail engagement may couple the retracting mechanism to the tub (e.g. rear wall). Moreover, in various embodiments, a magnet configuration or a pulley system may be used for coupling and rack height adjustment for maintaining operation of the retracting feature.

In some embodiments as shown, the dishwasher rack 20 may include a locking mechanism 70 securing the position of the dishwasher rack 20. The locking mechanism 70 may secure the dishwasher rack 20 in at least one deployed position. In various embodiments, the locking mechanism 70 may secure the dishwasher rack in the one or more stowed positions. One embodiment of the locking mechanism 70 as shown in FIGS. 3 and 4 is a pawl 72 and ratchet 74 engagement. The ratchet 74 is fixed to the shaft 51 and rotates about the vertical or rotating axis A. The pawl 72 pivots about an axis (e.g. vertical axis) relative to the ratchet. In some implementations, the ratchet 74 and pawl 72 may be positioned along the shaft 51 between the pinion gear 52 and the torsions spring 30 (e.g. within the housing 53). The pawl and ratchet engagement 72, 74 allows free motion in one rotational direction and provides a hard stop when turned the other rotational direction. For example, when the dishwasher rack 20 is pulled outward, the torsion spring 30 tightens to store energy, and the ratchet 74 and shaft 51 slips/rotates past the pawl 72. Moreover, when the user stops pulling and releases the dishwasher rack 20, the torsion spring 30 starts to urge/move the dishwasher rack 20 back towards the dishwasher tub 14, the pawl 72 will engage to the ratchet/shaft 74, 51 and hold the dishwasher rack 20 in the translational position. This locking mechanism or feature 70 may work at the fully extended position as well as any position between the stowed and deployed position, as well as the stowed position in some embodiments.

In some implementations, the retracting mechanism 50 and/or locking mechanism 70 may include a release mechanism 80. The release mechanism 80 allows the shaft 51 and/or pinion gear 52 to rotate freely when actuated. Actuation may occur in a variety of ways either with direct contact and/or motion by the user. In the one embodiment shown, the user operates a user release control 81 (e.g. a handle, button, or switch). The release control 81 is shown in one embodiment as adjacent a front wall 23 of the dishwasher rack 20. The release control 81 is linked to or in operable communication (e.g. unlock, lock) with the locking mechanism 70 of the retracting mechanism 50. The release control 81 may reset the locking/retracting mechanism 70, 50 in some embodiments. A release mechanism, if used, may be used to reset or return the locking mechanism and/or release mechanism back to a locked configuration or home position to cycle for another deployment of the dishwasher rack.

Figure 6:
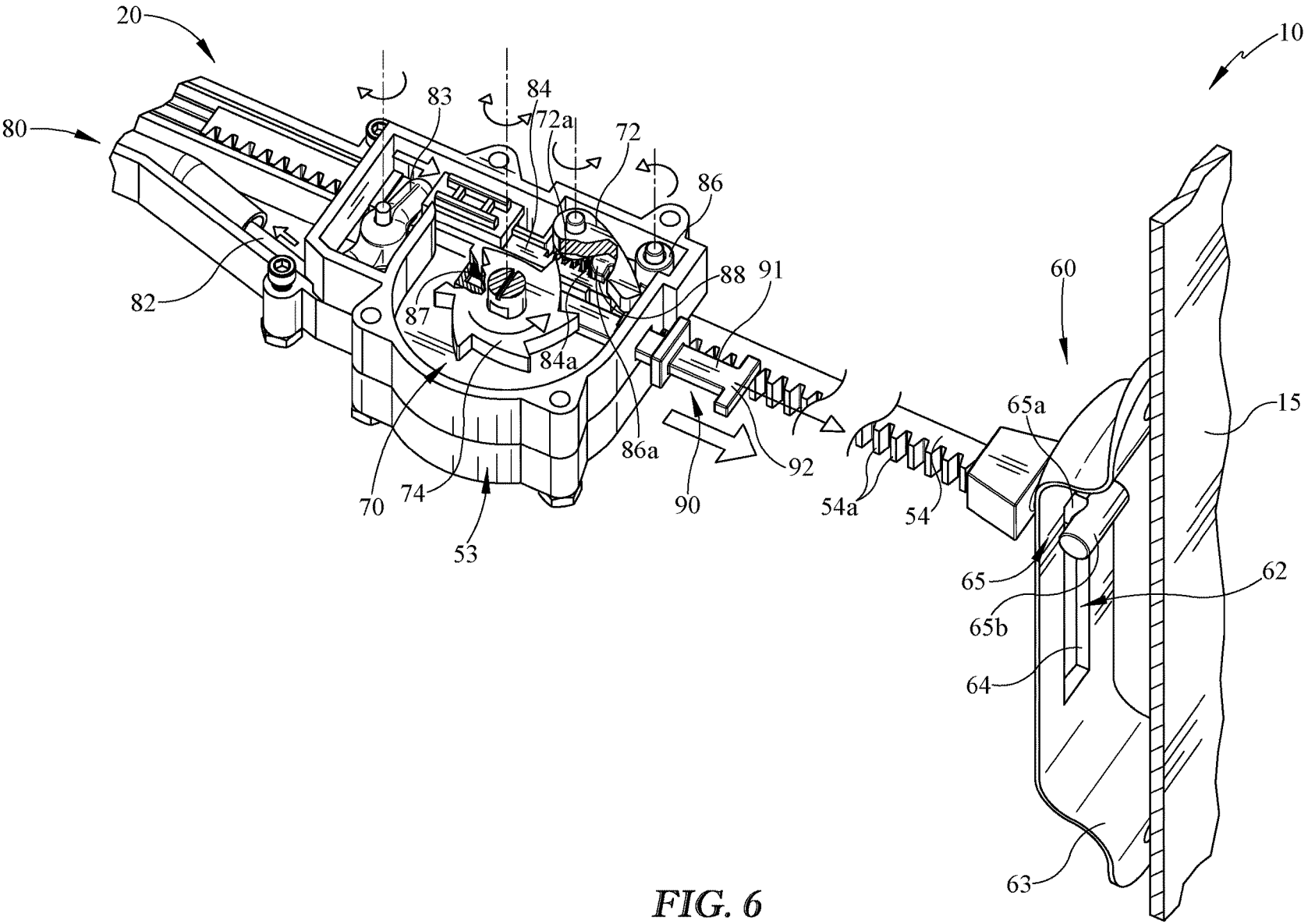
FIG. 6 is a perspective view of the dishwasher rack in an upper deployed position and illustrating an embodiment of the release mechanism positioning the rack and locking mechanism in an unlocked configuration releasably securing the position of the dishwasher rack and positioning the reset mechanism in the extended position.

In the one embodiment shown, the release mechanism 80 positions the locking mechanism 70 from a locked configuration (FIG. 4) to an unlocked configuration (FIG. 6). When in the locked configuration, the pinion gear 52 may rotate in the forward direction to allow the rack 20 to translate towards the deployed positon but not in a backward direction towards the stowed position. In the one embodiment shown when the locking mechanism 70 is in the locked configuration, the pawl 72 is operably engaging the ratchet 74 allowing free motion in one rotational direction and provides a hard stop when turned the other rotational direction. When the locking mechanism is in the unlocked configuration, the pinion gear 52 rotates in both the forward and backward directions allowing the rack 20 to translate between the stowed and deployed positions. As shown in FIG. 6, the pawl 72 is rotated out of engagement with the ratchet 74 when in the unlocked configuration. When the rack 20 is in the deployed position and the release mechanism 80 unlocks the locking mechanism 70, the torsion spring urges the dishwasher rack towards the stowed positon.

The locking mechanism 70 or pawl 72 may be rotated or moved out of engagement with the ratchet or to the unlocked configuration in a variety of ways to allow retracting of the dishwasher rack. As shown in the Figures, one embodiment of the release mechanism 80 is a cable mechanism 82, although a variety of linkage or mechanisms may be used. Releasing or lifting up on the handle or controls 81 disengages or unlocks the pawl/shaft/ratchet 72/51/74, via the cable 82 through the housing 53, if used, allowing the torsion spring 30 to auto-retract the dishwasher rack 20 back towards the dishwasher tub 14. In the one embodiments shown, the handle 81 via a cable 82 may pivot and/or translate linkage 83 to reposition the pawl 72 to the unlocked configuration. The cable 82 may rotate a member or linkage 83 to drive a geared rail 84 with teeth 84*a* rotational engaged to a gear teeth 72*a* of the pawl 72 or pawl shaft, wherein translation of the rail 84 rotates the pawl 72. The gear teeth 72*a* of the pawl/shaft 72 thereby rotates the pawl between the locked configuration (FIG. 3) and the unlocked configuration (FIG. 6). The geared rail 84 and pawl 72 may reset in a variety of ways. In the one embodiment, the geared rail and pawl may be spring loaded (e.g. spring 85) to reset/or return the rail/pawl to the locked configuration or rest position returning the pawl to the engaged or locked configuration.

The release mechanism may include a catch 86 in various embodiments. The catch 86 may be positioned or pivoted about an axis into and out of engagement with the locking and/or release mechanism. The catch may be spring loaded to reset or return to a variety of positons. As shown in FIG. 6, a catch 86 may be used to retain the locking mechanism (e.g. pawl 72) or release mechanism in the unlocked configuration to allow rack retraction for a distance. The catch 86 may be used to retain the geared rail 84 and/or pawl 72 of the release in the unlocked or extended configuration to maintain the pawl in the unlocked configuration. The catch 86 may be spring loaded (e.g. spring 87) in some embodiments. The linear positon of the geared rail 84 may position or correspond to the catch 86 between the unlocked configuration and locked configuration. Interference by the geared rail 84 may maintain the catch in the locked configuration for the pawl as shown in FIG. 3. A receptacle/opening or retaining feature 88 may be positioned within the geared rail 84 and when translated towards the catch (e.g. distal free end or hook 86*a*), the catch inserts into the retaining feature 88 and holds the geared rail/pawl 84/72 in the rotated and unlocked configuration when the rack is released from the deployed position.

In various embodiments, a reset mechanism 90 positions the locking mechanism 70 and/or release mechanism 80 from the unlocked position or configuration to the locked position or configuration. In the one embodiment shown, the reset mechanism 90 operates when the dishwasher rack 20 returns to the stowed position from the deployed position. In some implementations, the reset mechanism 90 returns the pawl 72 to the locked configuration (FIG. 3) allowing the dishwasher rack 20 to be deployed and subsequently locked in position relative to the dishwasher tub and/or portions of the retracting mechanism. In the one embodiment shown, the reset mechanism 90 resets the catch/pawl 86/72 when returned to the stowed position. It should be understood that the reset mechanism may be actuated in one or more positons of the dishwasher rack and while the rack is moving. The reset mechanism 90 disengages the catch 86 from the geared rail 84 allowing the pawl 72 to rotate and return to the locked configuration. The reset mechanism 90 may include a reset pin 91. The reset pin 91 may be triggered by contact when moving towards the stowed positon. The reset pin 91 may extend through the sidewall (e.g. rear side) of the housing 53. The reset pin 91 is positioned linearly via the catch 86 and may be spring loaded (e.g. spring 87) in a direction in some embodiments. As shown in FIGS. 3 and 4, the reset pin 91 is in a retracted positioned within the housing 53 when the catch 86, rail 84, and/or pawl 72 is in the locked configuration. Correspondingly, as shown in FIG. 6, the reset pin 91 is positioned in an extended positon away from the housing 53 when the catch 86 holds the pawl 72 and/or rail 84 in the unlocked position. The spring 87 may urge the reset pin 91 to the extended position. With the reset pin in the extended position and the torsion spring 30 returning with the rack to the stowed position as in FIG. 6, the free end 92 (e.g. a T-bar shaped end) of the reset pin 91 abuts or makes contact with structure pushing/translating the reset pin 91 to release the catch 86. The reset pin 91 rotates the catch 86 or hook 86*a* from the retaining feature 88 of the rail 84 when the reset pin translates from the extended positon to the retracted position. In the embodiment shown, the reset pin may have a retaining feature or receptacle engaging a pivot arm of the catch to rotate the catch hook 86*a* from the rail 84. Correspondingly, the pivot arm of the catch or catch 86 translates the reset pin from the retracted position to the extended position when the catch 86 rotates from the locked configuration to the unlocked configuration. In the one embodiment shown in FIG. 3, the triggering structure that the reset pin 91 contacts to push the reset pin in one or more directions may be the rear wall 15 of the tub 14 and/or height adjustment mechanism 60 (e.g. bracket 63) when the dishwasher rack 20 is in at least one of the one or more heights (e.g. upper, lower heights) of the dishwasher rack 20. It should be understood that the reset pin may make contact with or be pushed between the extended and retracted positions by a remaining portion of the appliance and/or rack that is fixed in positon relative to the dishwasher rack.

Although a handle or manual release control 81 may be used in some embodiments to disengage the locking mechanism 70, the user may push or pull the dishwasher rack 20 with sufficient force and distance in at least one direction (e.g. towards or away from the dishwasher tub and/or upwards/downwards) and release the rack to engage the auto-retract feature and allow the torsion spring 30 to use the stored energy to position the dishwasher rack towards and/or to the stowed/home position. If a handle is used in some embodiments, such as without a reset mechanism 90, the handle may stay released from the locking mechanism 70 for sufficient time to allow the dishwasher rack 20 to return to the stowed position before reengagement. For example, a handle may be reset back (e.g. by a cam, spring, and/or damper) to the home position when reaching or approaching the stowed position.

Figure 5:
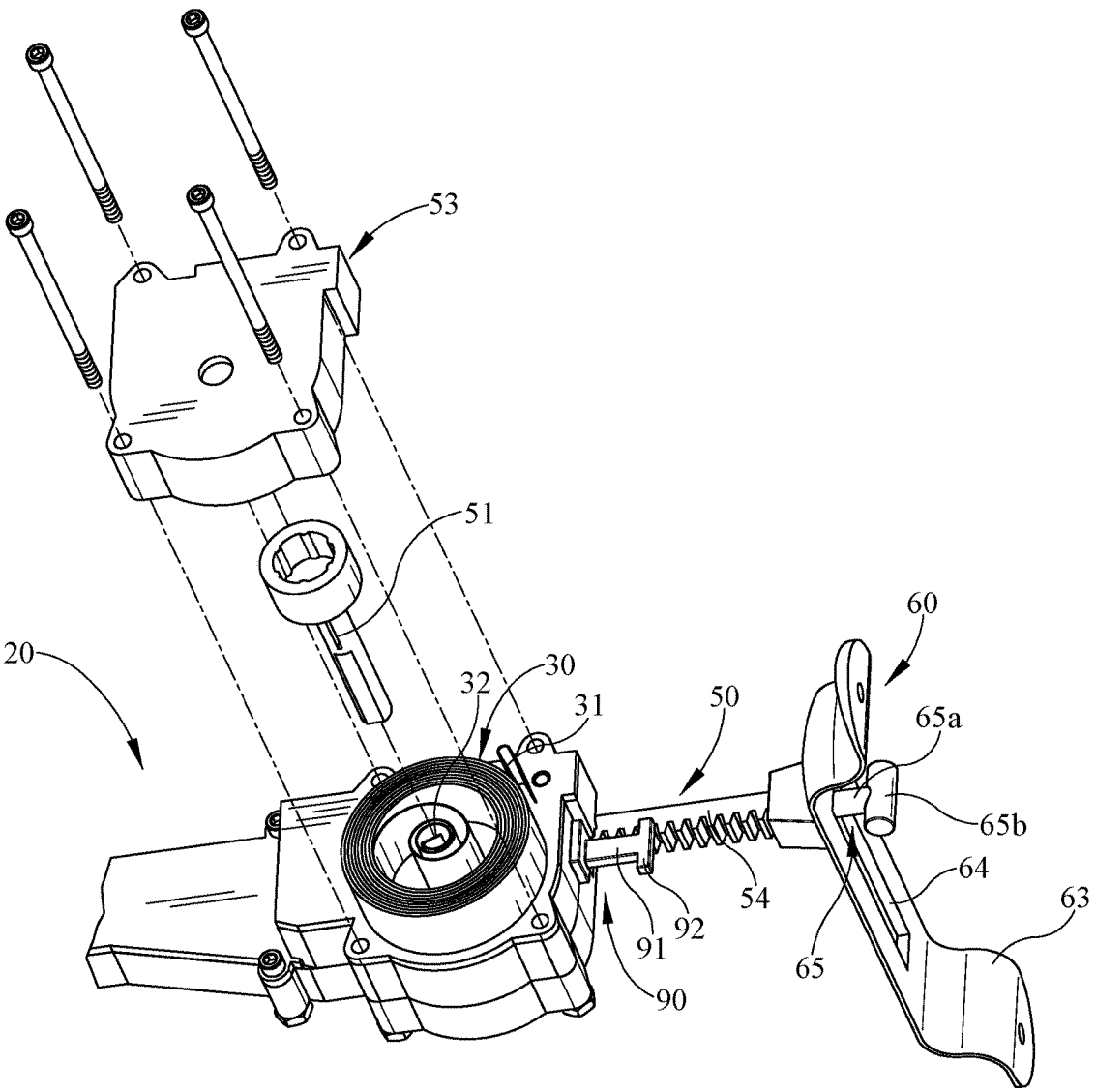
FIG. 5 is an enlarged perspective view of a portion of the dishwasher rack of FIG. 3 with the retracting mechanism and the rack in the upper deployed position and illustrating an embodiment of the torsion spring in a tensioned state.
Figure 7:
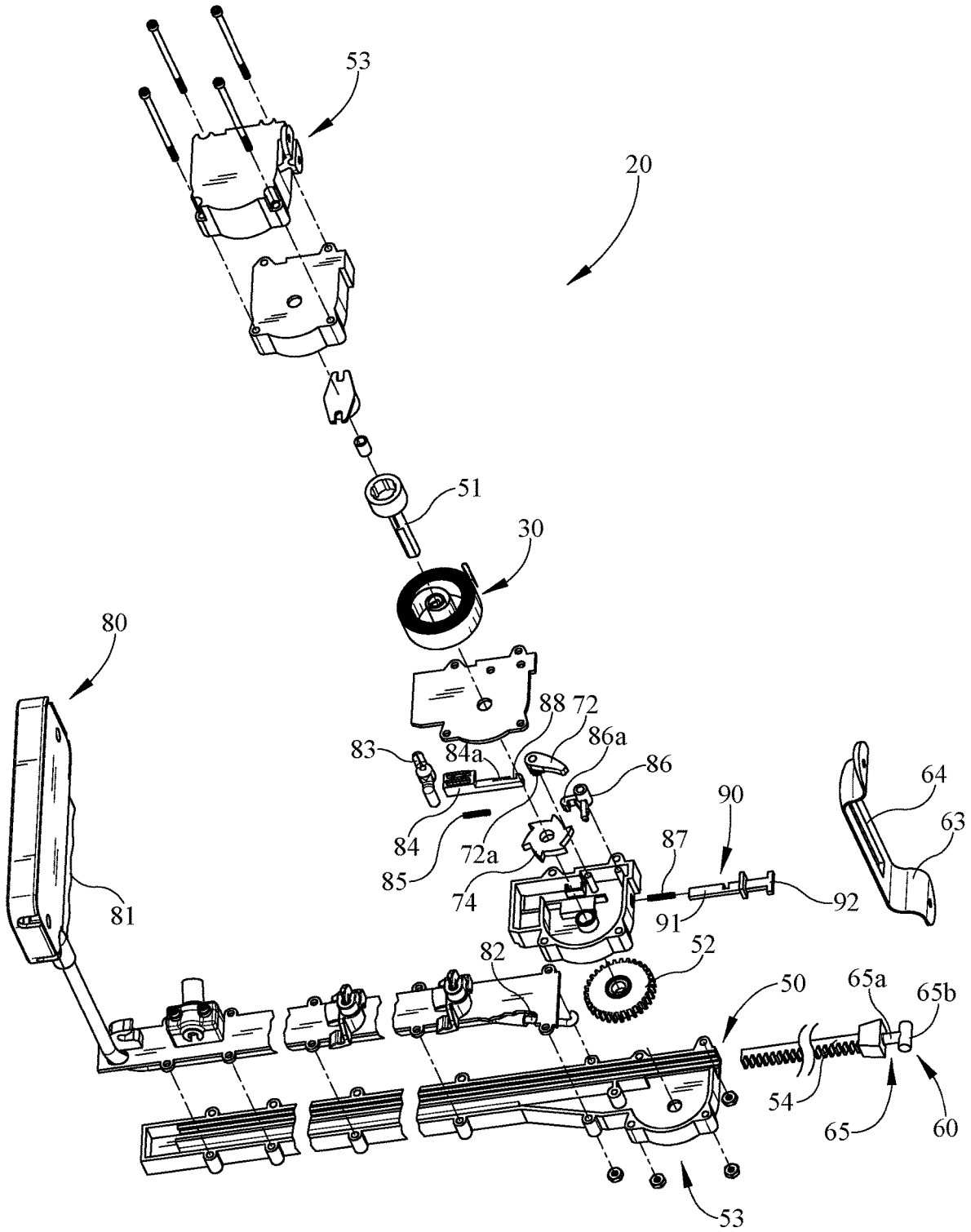
FIG. 7 is a perspective exploded view of the embodiment of the retracting, locking, and reset mechanisms.
Figure 8:
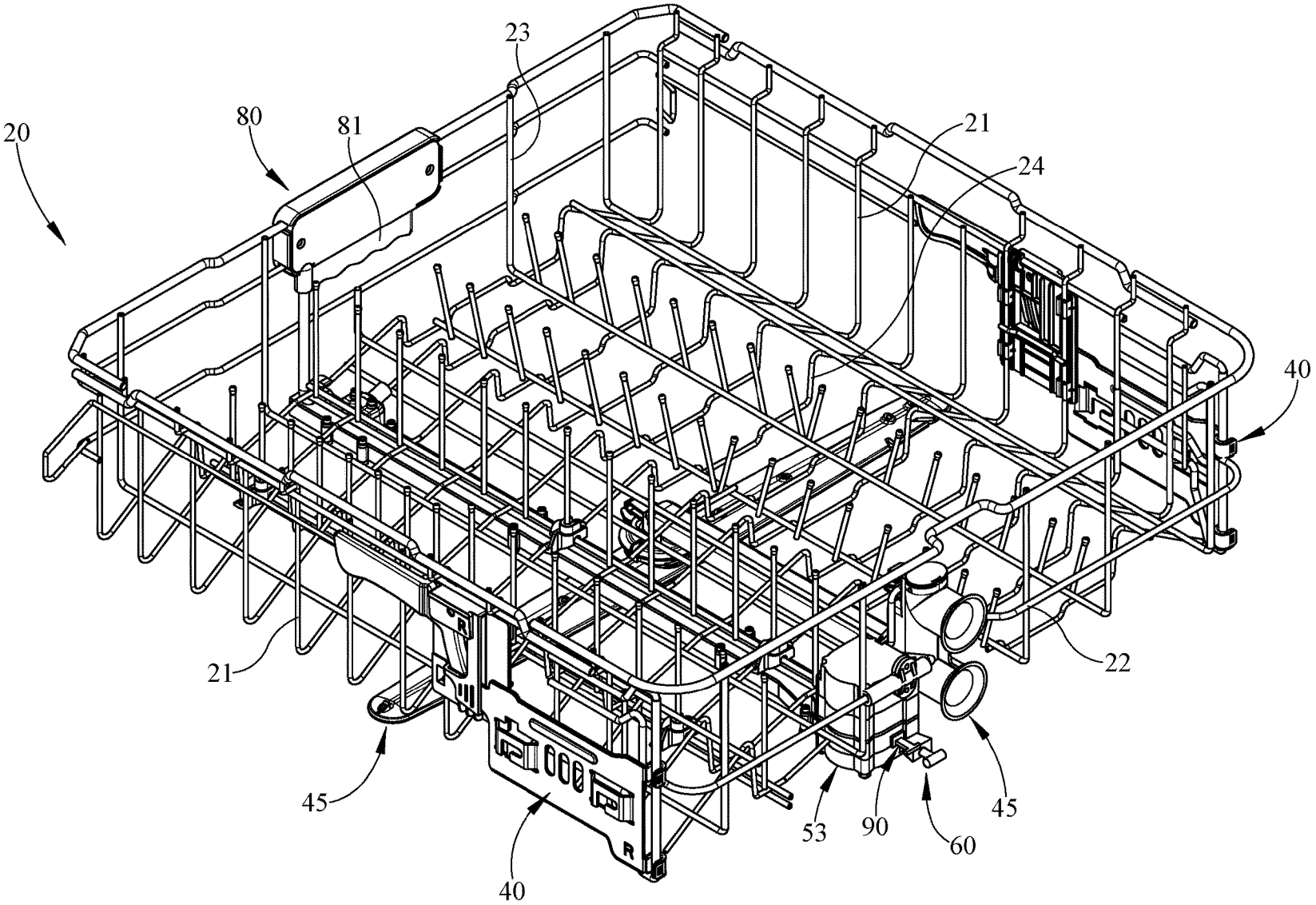
FIG. 8 is a perspective view of the embodiment of the dishwasher rack of FIG. 1.

In addition, in various embodiments, the dishwasher rack 20 may include a housing or gearbox 53 to include one or more portions of the retracting mechanism 50, reset mechanism 90, release mechanism 80, etc. The housing or gearbox 53 is positioned adjacent the rear wall 22 of the dishwasher rack 20. In various embodiments, the housing may extend along the rack from the rear wall 22 to the front wall 23 of the rack or adjacent the release controls in some embodiments. The reset pin 91, release control 81, and/or the rack gear 54 may extend/retract/proj ect from the housing, if used. The housing 53 may include the torsion spring 30, the ratchet 74, the geared wheel 52, the shaft 51, the pawl 72, the catch 86, etc. or portions thereof as shown in the Figures. The torsion spring 30 may be positioned within the housing 53 in some embodiments as shown in FIGS. 5 and 7. A fixed end 31 of the torsion spring 30, opposite a fixed end 32 attached to the shaft 51, may be secured to the housing 53, if used, in some embodiments. In some embodiments, the torsion spring 30 may be attached to the shaft 51 and a variety of other structure of the translating dishwasher rack 20. Although, one torsion spring 30 and/or one housing 53 is shown as being used in one embodiment, a plurality of springs 30 and/or housings 53 may be used on one shaft 51 or a plurality of geared shafts. Although the torsion spring 30 may be shown in the housing 53 in the embodiments, the torsion spring 30 may be combined with the one or more geared engagements or wheels 52 and/or the geared rail 54. As shown more clearly in FIG. 7, the housing 53 may have one or more compartments for the internal structure. As shown in the one embodiment, one sequence within the housing from bottom to top may be the pinion gear 52 and rack gear 54, the ratchet 74, pawl 72, catch 86 and reset pin 91, and the torsion spring 30. The shaft 51 may extend through the housing/compartment between the pinion gear, ratchet, and the torsion spring. Moreover, the housing 53 may be sealed (e.g. hermetically sealed, gaskets, etc.) to reduce water and/or detergent from entering. In some embodiments, the housing 53 may also include one or more drains or weep holes to allow moisture to escape.

In some embodiments, the dishwasher rack 20 may include one or more dampers or dampening devices (not shown). One or more dampers may slow the translation of the dishwasher rack 20 from one position to another (e.g. into and/or out of the dishwasher tub, or from the deployed position to another position or stowed position). The damper may limit the retracting speed to one or more values. The damper may be a rotational damper (e.g. friction or liquid) attached to the shaft 51 and/or rack wire basket. The rotational damper may slow down the rotation of the shaft 51 and/or gear wheels 52 and correspondingly the translation of the dishwasher rack 20 in at least the direction towards the dishwasher tub 14 and/or stowed position. It should be understood that the dampers may be a variety of constructions, quantities, positions, and sizes and still be within the scope of the invention. For example, the damper may be a linear damper (e.g. a mechanical spring or pneumatic cylinder). Moreover, the damper may be located within the housing 53 in some embodiments. The damper and the torsion spring 30 may be attached to the shaft 51 and positioned within the housing. Moreover, a one-way damper may be used to lock the dishwasher rack in tension in one or more positions. The one-way damper may maintain the position of the rack, until an additional force is applied to push/pull the rack into/out of the tub to unbalance the tension from the torsion spring and the friction damper.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dish washing appliance comprising:

a dishwasher tub;

a dishwasher rack, wherein the dishwasher rack is positionable between a stowed position in the dishwasher tub and a deployed position, wherein the deployed position is different from the stowed position; and wherein the dishwasher rack includes a rail having geared teeth, a geared wheel rotationally fixed to a shaft, and a torsion spring, and wherein the geared wheel and the shaft rotationally translate together along the geared teeth of the rail between the stowed position and the deployed position;

wherein the torsion spring is secured to the shaft and wherein translating the dishwasher rack from the stowed position towards the deployed position rotates the shaft and correspondingly increases the spring force of the torsion spring urging the dishwasher rack to return towards the stowed position; and the dishwasher rack further includes a pawl and a ratchet locking the dishwasher rack in the deployed position, wherein the ratchet is secured to the shaft.

2. The dish washing appliance of claim 1 wherein the shaft is positioned vertically.

3. The dish washing appliance of claim 1 wherein the rail is positioned inwardly from opposing sides of the dishwasher rack adjacent opposing side walls of the dishwasher tub.

4. The dish washing appliance of claim 1 wherein the dishwasher rack further includes a housing, wherein the torsion spring, the ratchet, the geared wheel, and the pawl are positioned within the housing.

5. The dish washing appliance of claim 4 wherein the housing is positioned adjacent a rear side of the dishwasher rack.

6. The dish washing appliance of claim 4 wherein the ratchet and the pawl are positioned between the torsion spring and the geared wheel within the housing.

7. The dish washing appliance of claim 1 wherein the rail projects from a rear wall of the dishwasher tub to the dishwasher rack.

8. The dish washing appliance of claim 1 wherein the torsion spring is a spiral spring.

9. The dish washing appliance of claim 1 wherein the rail is positioned between a spray arm assembly and a basket of the dishwasher rack in a direction of travel from the stowed position to the deployed position.

10. A dish washing appliance comprising:

a dishwasher tub; and a dishwasher rack comprising a basket, wherein the basket is capable of occupying a stowed position within the dishwasher tub;

a shaft having a geared wheel fixed relative to the shaft, the geared wheel rotationally engaging a rail with corresponding geared teeth;

a torsion spring and a ratchet secured to the shaft, when the basket and the shaft translate from the stowed position thereby rotating the shaft relative to the rail, tension in the torsion spring increases and urges the dishwasher rack towards the stowed position; and a pawl operably engaging the ratchet to lock the rotation of the geared wheel relative to the rail.

11. The dish washing appliance of claim 10 wherein the dishwasher rack further comprises a housing, wherein the housing includes the geared wheel, the shaft, the ratchet, the torsion spring, and the pawl.

12. The dish washing appliance of claim 11 wherein the housing is adjacent a rear wall of the basket.

13. The dish washing appliance of claim 10 wherein the shaft is vertically positioned.

14. The dish washing appliance of claim 10 wherein the rail is spaced inwardly from each side wall of the basket.

15. The dish washing appliance of claim 10 wherein the one or more torsion springs is a spiral spring.

* * * * *